US006328340B1

(12) United States Patent
Fischer

(10) Patent No.: US 6,328,340 B1
(45) **Date of Patent: *Dec. 11, 2001**

(54) FORM WITH DETACHABLE CARD, SUBSTRATE AND MULTILAYER MATERIAL, AND PROCESS FOR PRODUCING SUCH A FORM

(75) Inventor: Jules Fischer, Widen (CH)

(73) Assignee: Fofitec AG, Dottikon (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/269,265

(22) PCT Filed: Sep. 11, 1997

(86) PCT No.: PCT/CH97/00335

§ 371 Date: Jun. 10, 1999

§ 102(e) Date: Jun. 10, 1999

(87) PCT Pub. No.: WO98/13213

PCT Pub. Date: Apr. 2, 1998

(30) Foreign Application Priority Data

Sep. 25, 1996 (CH) ..... 2340/96

(51) Int. Cl.[7] ..... B42D 15/00

(52) U.S. Cl. ..... 283/62; 283/61; 283/101; 428/42.2

(58) Field of Search ..... 283/109, 108, 283/107, 81, 82, 62, 75, 101; 281/4, 6; 428/42.2, 40.1, 41.9, 42.3, 42.1, 121, 138, 914

(56) References Cited

U.S. PATENT DOCUMENTS

| | | | | |
|---|---|---|---|---|
| 627,920 | * | 6/1899 | Gould . | |
| 2,768,458 | * | 10/1956 | Anania | 40/665 |
| 4,890,862 | * | 1/1990 | Buchholz | 283/62 |
| 4,914,843 | * | 4/1990 | De Woskin | 40/633 |
| 5,039,652 | * | 8/1991 | Doll et al. | 503/206 |
| 5,381,617 | * | 1/1995 | Schwartztol et al. | 40/6 |
| 5,413,532 | | 5/1995 | Raby | 462/2 |
| 5,439,255 | * | 8/1995 | McIntire et al. | 283/62 |
| 5,462,488 | | 10/1995 | McKillip | 462/26 |
| 5,466,013 | * | 11/1995 | Garrison | 283/107 |
| 5,688,573 | * | 11/1997 | Goeb et al. | 428/40.1 |
| 5,736,212 | * | 4/1998 | Fisher | 428/42.2 |
| 5,792,536 | * | 8/1998 | Whipp | 428/40.1 |
| 5,910,348 | * | 6/1999 | Hart-Smith et al. | 428/41.5 |
| 6,022,051 | * | 2/2000 | Casagrande | 283/107 |

FOREIGN PATENT DOCUMENTS

| | | |
|---|---|---|
| WO 95/05281 | 2/1995 | (WO) . |
| WO 95/19892 | 7/1995 | (WO) . |
| WO 95/20493 | 8/1995 | (WO) . |

* cited by examiner

*Primary Examiner*—Willmon Fridie, Jr.
(74) *Attorney, Agent, or Firm*—Morgan, Lewis & Bockius LLP

(57) ABSTRACT

This invention concerns a form (1) which has an integrated card (3) which can be detached from it. A substrate material (2) is glued to the back of the form at least partly covering the area of the card (3). This substrate material (2) has both a substrate layer (21) and a peeling adhesive layer (22) which loses its stickiness upon being detached. The card (3) is a punched product which is held in the form (1) by the substrate layer (21). The peeling adhesive layer (22) has its normal properties with respect to the substrate layer (21)—when separated from it upon detaching the card (3), it (22) stays with the card (3). As the surface layer of the detached card (3), it can be written or printed upon, even if the back of the card is plasticized by a film (23) embedded in the substrate material. The writing or imprint can no longer easily be modified through the peeling adhesive layer (22). This makes the card considerably more tamper-proof than earlier cards. Designing the card as a luggage tag is an interesting application. The invention also concerns a substrate material (2) or a completely integrated multilayer material for a form (1) of the preciously described kind as well as a process for production.

18 Claims, 5 Drawing Sheets

FORM WITH DETACHABLE CARD, SUBSTRATE AND MULTILAYER MATERIAL, AND PROCESS FOR PRODUCING SUCH A FORM

BACKGROUND OF THE INVENTION

The present invention concerns a form with a detachable card, a substrate material being glued to the back of the form, which substrate material at least partly covers the area of the card and comprises both a substrate layer and a peeling adhesive layer which loses its stickiness upon being detached, and the card being a punched product which is held in the form by the substrate layer and is produced by a punching carried out from the front of the form as far as the substrate layer.

Finally, the invention also concerns a substrate material and a multilayer material for forms of the type referred to above as well as a production process.

DESCRIPTION OF THE PRIOR ART

A form of the type referred to above is known, for example, from WO95/20493. In that case, the peeling adhesive layer has its typical properties with respect to the card. This means that the peeling adhesive layer develops a permanent adhesive effect with respect to the substrate layer but a non-permanent adhesive effect with respect to the card. The card can be detached from the form free from adhesive, the peeling adhesive layer remaining on the substrate layer. Since the card is not sticky, it can be used, for example, as an identity card or the like. A further property of the known peeling adhesive layer is that, after detaching the card, it no longer sticks where it is exposed. The form can therefore be subsequently used further and, for example, also be filed.

An important requirement for identity cards and also other cards is that they can be written or printed on and, as a result, once the form has been produced, it is possible, for example, to apply personal data. It is also intended that such writing or such an imprint cannot be subsequently changed, at least not easily, in particular in the case of identity cards, in the sense of a certain tamper-proof security.

It is customary to provide in the substrate material, before the peeling adhesive layer and the substrate layer as seen in the punching direction, also at least one permanent pressure-sensitive adhesive layer and an outer layer, for which at least one film is used. The rear surface of the detached card is plastified if a film is used and in this way is advantageously protected against moisture and other influences. There is generally also a similar outer layer on the front of the card. What is disadvantageous, however, about plastifying is that it is scarcely possible any longer to write or print onto the card after its removal. Although it is known in principle to make it possible for smooth film surfaces to be written or printed on by applying a special coating, such a coating would require at least an expensive, separate operation. With the coatings commonly used, moreover, there would be the difficulty of integrating them in a peeling adhesive system of the type referred to above, since all the currently known peeling adhesives develop a permanent adhesive effect with respect to said coatings, which would not allow nondestructive detachment of the cards.

It is known from the aforementioned WO95/204932 to make it possible to write on the back of the card by punching out a window in the substrate layer from the back and providing the film surface exposed in said window with a matt finish. However, additional operations are also necessary for this. Since the window is necessarily smaller than the card, the latter also cannot be written on over its full surface area.

It is known from forms with detachable self-adhesive labels (compare for example WO95/05281) to provide instead of a peeling adhesive layer a pressure-sensitive adhesive layer with a permanent adhesive effect on both sides and to use a silicone-treated release paper as the substrate layer. As a result, when the label is detached the pressure-sensitive adhesive layer comes away from the release paper and stays with the label. Since it is the intended purpose of self-adhesive labels to be able to be adhesively attached again, the pressure-sensitive adhesive must not lose its stickiness when the label is detached from the form.

SUMMARY OF THE INVENTION

The object of the invention is to specify a form of the type ref erred to at the beginning in which the back of the card can be written or printed on over its full surface area after detaching the card, in which the writing or imprint cannot be easily changed subsequently, in which a separate precoating of, for example, an outer or reinforcing film used is not required and in which both the rear surface of the card and the surface exposed in the form by detaching the card no longer stick after detaching the card.

This object is achieved according to the invention by a form having the features specified in patent claim 1.

Whenever the back of the card is formed by a film, i.e. if a film is used for the form material or an additional outer layer contained in the substrate material, said film can be written and printed on through the peeling adhesive layer according to the invention on the detached card. The peeling adhesive layer according to the invention consequently has a dual function, making it unnecessary for the film surface to be coated in an additional and expensive operation (assuming that a coating suitable for this could be found in the first place).

A further advantageous property of the peeling adhesive layer according to the invention is that it is scarcely possible for writing or an imprint applied to it to be changed subsequently. This is so in particular in the case in which the back of the card is formed by a paper material. The card detached from the form according to the invention and then written on is consequently tamper-proof to an increased extent. In the case where the back of the card is of paper, it is virtually plastified by the peeling adhesive layer according to the invention and given water-repellent properties even without the use of a film.

The following composition may be chosen for the peeling adhesive of the peeling adhesive layer:

| | |
|---|---|
| 70–90% | mixture of an ethylene-containing copolymer, a copolymeric ethyl acetate dispersion, an acrylic resin copolymer and a polyvinyl acetate polymer, |
| 3–5% | aliphatic polyester urethane acrylate |
| 1.5–2.5% | 2-acrylic acid, 2-(((butylamino)carbonyl)oxy)ethylester, |
| 12–18% | modified anionic pure acrylate copolymer emulsion, |
| 0–1.5% | wetting agent, and |
| 0.5–1.5% | aliphatic polyfunctional isocyanurate. |

The main component of the peeling adhesive formulation, the mixture of an ethylene-containing copolymer, an ethyl acetate dispersion, an acrylic resin copolymer and a polyvinyl acetate polymer, produces the actual peeling properties of the peeling adhesive. The adhesive force of this adhesive assumes a certain value, and the layer can be peeled off in a smooth, noiseless way and without leaving any residue. The polyvinyl acetate polymer, as the best re-emulsifiable and most water-sensitive component, makes it possible for the film to be printed on, in particular with ink-jet inks. The aliphatic polyester urethane acrylate increases the elasticity and water resistance of the film and improves the film strength as well as the anchorage on plastic surfaces. The substance 2-acrylic acid, 2-(((butylamino)carbonyl)oxy) ethylester serves as an addition to the aliphatic polyester urethane acrylate. Reactive groups present, such as amino or carbonyl groups for example, react simultaneously with pigments, which make possible a smudge-proof fixing of ink-jet inks, even if there is subsequent water contact of the film surface. The pure acrylate copolymer emulsion increases the film cohesion and closes its surface, which prevents excessive clouding of the film on contact with water. The wetting agent reduces the surface tension and consequently influences the rheology of the wet film and the wetting of the dry film by ink-jet inks in a positive sense. The aliphatic polyfunctional isocyanurate crosslinks the individual components and, like the aliphatic polyester urethane acrylate as well, improves the adhesion of the film on the substrate film. The crosslinking likewise increases the film hardness and resistance.

The peeling adhesive composition referred to above is particularly well suited for use in connection with polyester films, it being possible for such a film to be used both for the substrate layer and for the outer layer. The different adhesive effect with respect to the substrate layer on the one hand (non-permanent) and the outer layer on the other hand (permanent) can in this case be achieved by suitable process control and/or different pretreatment of the film surfaces on both sides. For example, a permanent adhesion of the peeling adhesive according to the invention on the film used for the outer layer can be achieved by a plasma, corona or flame treatment of this film, whereas the same peeling adhesive develops only a non-permanent adhesion with respect to the same, but untreated film. A differentiated adhesive effect can also be achieved by means of different types of film. For example, a peeling adhesive of the above composition adheres more weakly to a polypropylene film than to a polyester film. Different films could of course additionally undergo a different surface pretreatment.

The peeling adhesive layer according to the invention can be printed on by the commonly used printing processes, such as by a laser or ink-jet printer and a typewriter for example, and can be written on by hand with a fountain pen, a ballpoint pen, an indelible pen or a pencil.

Interesting possible applications for the form according to the invention are obtained if the card is designed as a tag. When sending travel documents to their customers, as a special service travel agencies often enclose tags which can be attached by the customers to their baggage, for example to a case. The tags are also often already written on by the travel agency, with not only the name and address of the customer but also further information, such as destination, flight number, hotel or the like, printed on the tag. However, some of the tags used are of a complex design and therefore expensive, unnecessarily bulky or heavy and, as a result, difficult to send, or in any event cannot be written on without additional effort and additional equipment.

By contrast, a form of the type according to the lip invention with a card designed as a tag can be used by the travel agency directly for the letter or cover letter to the customer, on which the tag is written on in the same operation as that in which the letter is produced and printed out, for example on a computer printer. The tag then does not require any additional actions to be carried out on the part of the travel agency. Tags also do not have to be separately obtained and stored any longer.

In comparison with known tags, the tag integrated in the form according to the invention is much more cost-effective. There are likewise no additional problems during sending, in particular the item sent to the customer is made virtually no heavier nor bulkier by the integrated tag. The use of film outer layers makes it possible to ensure that the tag is adequately stable, tear-resistant and also moisture-resistant. Claim 16 concerns a process for producing a form of the type according to the invention. Use of a substrate material according to claim 17 or a fully integrated multilayer material according to claim 18 allows forms of the type according to the invention to be produced particularly efficiently.

BRIEF DESCRIPTION OF THE DRAWINGS

The invention is to be explained in more detail below on the basis of exemplary embodiments in connection with the drawing, in which.

DESCRIPTION OF THE PREFERRED EMBODIMENTS

Figure 1:
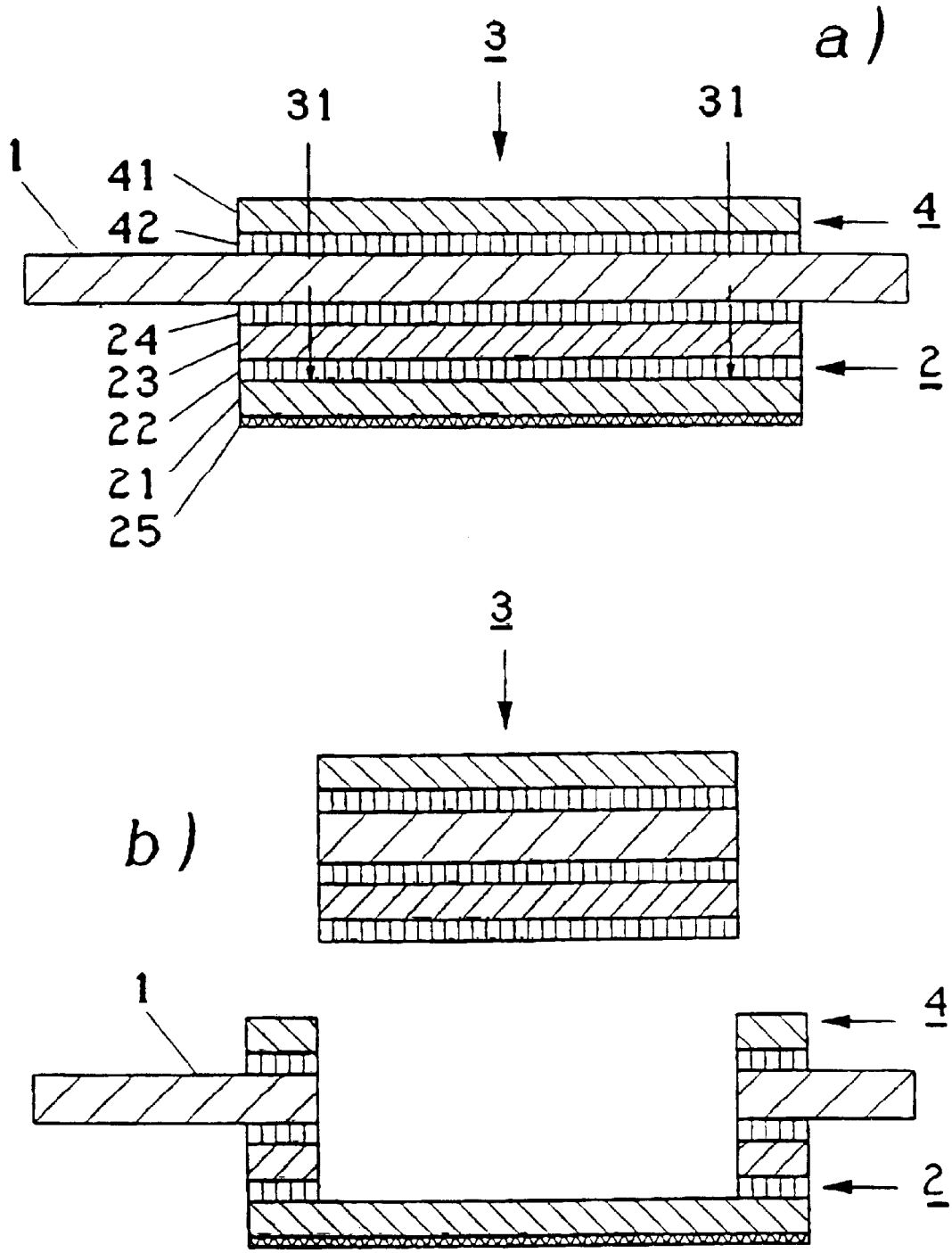
FIGS. 1(*a*) and 1(*b*) show a sectioned representation a first, preferred embodiment of a form sheet according to the invention.

In FIG. 1, 1 denotes a form sheet made of paper, on which any desired information, a specimen or the like can be printed on one or both sides. 2 denotes a piece of a substrate material, which comprises a substrate layer 21, a peeling adhesive layer 22, an outer layer 23 and a permanent pressure-sensitive adhesive layer 24. The substrate material is glued to the back of the form by means of the permanent pressure-sensitive adhesive layer 24. A piece of a covering material 4, which likewise comprises an outer layer 41 and a permanent pressure-sensitive adhesive layer 42, is provided on the front of the form. The two outer layers 23 and 41 are transparent plastic films, in particular polyester films, through which any imprint on the form sheet 1 in the area of the card 3 can be seen. The outer layers serve for stiffening the card 3 and lend it a water-repellent and abrasion-resistant surface.

From the front of the form sheet 1, as illustrated by the arrows 31 in FIG. 1*a*), a punching which is preferably continuous, i.e. running all the way around without intermittent material, is carried out within the surface area of the substrate material 2, penetrating all the layers 41, 42, 1, 24, 23 and 22 and reaching down as far as the substrate layer 21.

The punching has the effect of cutting out from the form sheet 1 a punched product, the card 3, which no longer has any connection with the surrounding material of the form sheet 1 and is held in the form sheet 1 merely by the substrate layer 21 not punched through in this operation.

According to the invention, the peeling adhesive of the layer 22 is adjusted in such a way that the card 3 is on the one hand held sufficiently firmly and securely in the form sheet 1, i.e. is not prematurely detached when the form sheet 1 is handled in the way intended or else automatically processed, but on the other hand is easily detachable from the sheet 1. During detaching of the card 3, the peeling adhesive 22 is completely detached from the substrate layer 21 and stays with the card. The peeling adhesive layer 22 has to this extent a non-permanent adhesive effect with respect to the substrate material 21 and a permanent adhesive effect with respect to the material of the outer layer 23. FIG. 1*b*) shows the form with the detached card 3, which bears the peeling adhesive layer 22 on the back. The detachment from the substrate material 21 has, however, caused this layer to lose its stickiness, so that the card 3 is not self-adhesive. The no longer sticky peeling adhesive layer can be written or printed on by means of the commonly used writing implements or printing processes.

The substrate material 2 is preferably prefabricated completely as such and then applied as a whole to the back of the form. This is much more cost-effective than applying the individual layers one after the other. The substrate material may, in particular, be supplied to the form manufacturer as an endless material in roll form by a film manufacturer or film finisher specializing in this respect. Since the uppermost layer 24 is a permanent pressure-sensitive adhesive layer, it is of advantage to take special measures in order that the substrate material 2 can be rolled up on itself. Such a measure is, for example, a rear release coating of the substrate layer 21 by means of an applied layer of silicone. Such a layer is denoted in FIG. 1 by 25. Alternatively, the substrate material 2 could initially also be provided with an additional layer of release paper, which would however become scrap during production of the forms. This technique is suitable in particular for the covering material 4 on the front of the form, which can then also be prefabricated and applied as a whole. Finally, it would also be possible to integrate all the layers, including the form material itself, in a single, uniformly constructed multilayer material in endless form, in which all the layers are of the same size. The material according to FIG. 4, still to be described in detail later, could, for example, be such a multilayer material. The [lacuna] produced from such a material would have a uniform thickness over their entire surface area and, as a result, be particularly suitable for further processing, for example in single-sheet printers.

Figure 2:
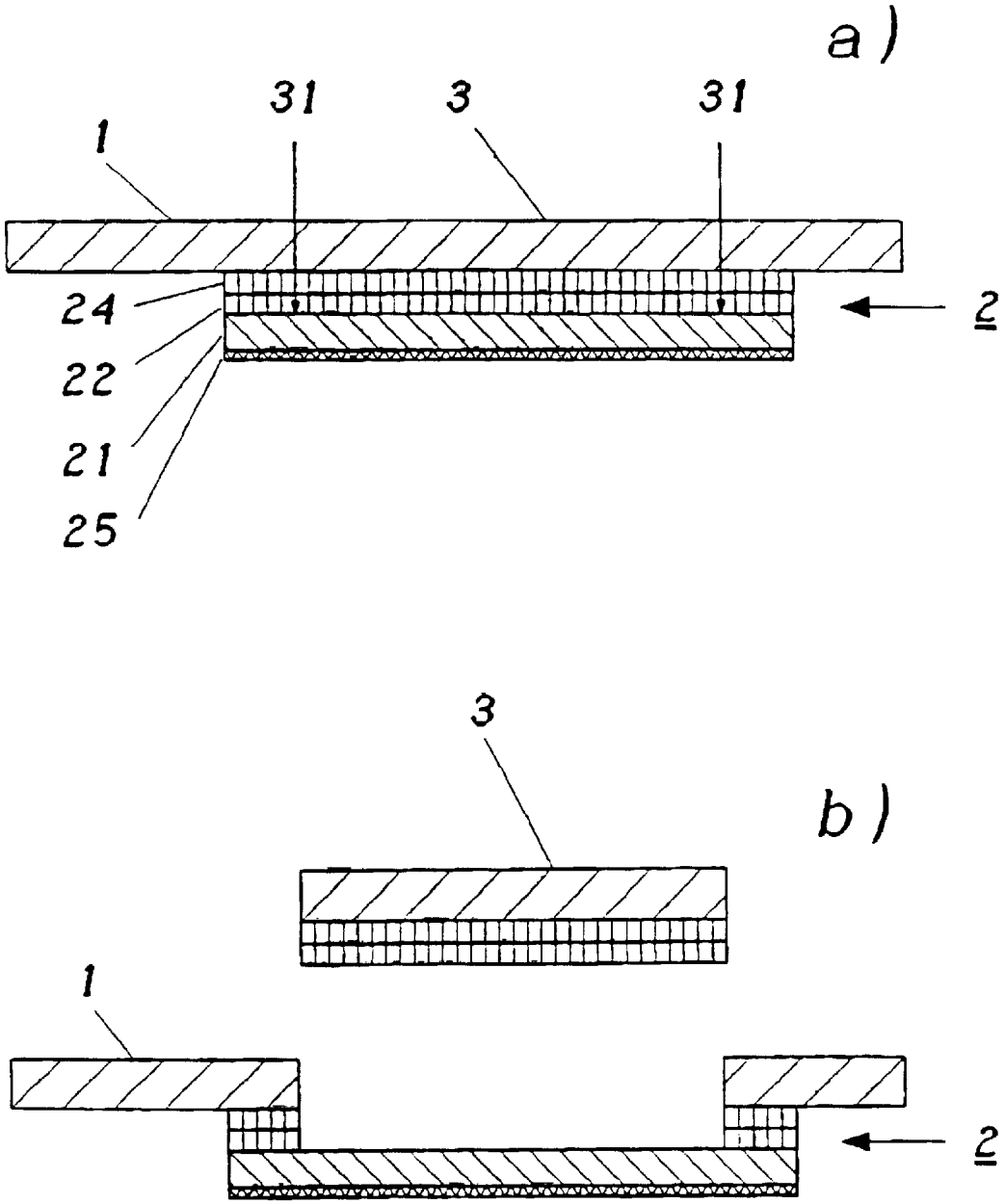
FIGS. 2(*a*) and 2(*b*) show a sectioned representation a simplified embodiment, in which no film outer layers are provided.

FIG. 2 shows an exemplary embodiment in which, in comparison with FIG. 1, the two outer layers 23 and 41 as well as the permanent pressure-sensitive layer 42 underneath the front outer layer 41 have been omitted. The peeling adhesive layer according to the invention is in direct contact here with the permanent pressure-sensitive adhesive layer 24. Although in fact functionally unnecessary in the finished form, the permanent pressure-sensitive adhesive layer 24 has been intentionally left in order that the substrate material 2 as a whole can again be prefabricated. Without the permanent pressure-sensitive adhesive layer 24, the peeling adhesive of the peeling adhesive layer 22 would have to be applied in the wet state to the back of the form. Both adhesive layers are detached from the substrate layer 21 during detaching of the card 3 and stay with the latter. Although in the case of this embodiment it would be possible to write or print directly onto the back of the card even without the adhesive layers, the coating with the two adhesive layers is nevertheless of advantage, since writing or an imprint applied to them can subsequently be changed again only with difficulty. The adhesive also additionally gives the surface of the card film-like properties, i.e. it acts plastified.

Figure 3:
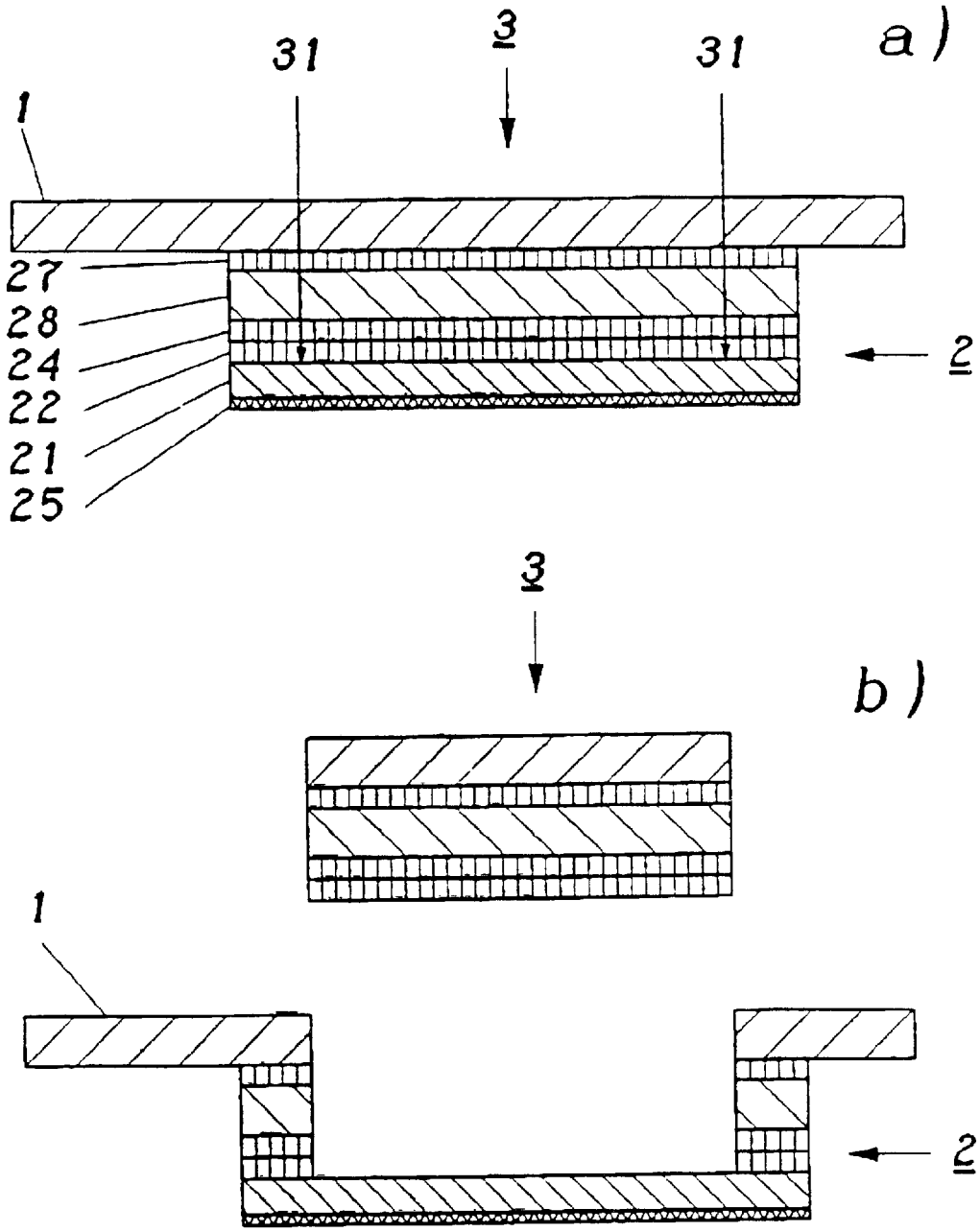
FIGS. 3(*a*) and 3(*b*) show a sectioned representation an embodiment with doubled layers of the film material.

In FIG. 3, to stiffen the card 3 the layer structure from FIG. 2 in the substrate material 2 has been supplemented by a self-supporting layer 28 made of the form material as well as by a permanent pressure-sensitive adhesive layer 27. The layer 28 may be printed on in the same operation as the form sheet on a secondary path.

The peeling adhesive of the peeling adhesive layer preferably has the following composition in % by weight:

| | |
|---|---|
| 77% | mixture of an ethylene-containing copolymer, a copolymeric ethyl acetate dispersion, an acrylic resin copolymer and a polyvinyl acetate polymer, |
| 4% | aliphatic polyester urethane acrylate, |
| 2% | 2-acrylic acid, 2-(((butylarnino)carbonyl)oxy)ethylester, |
| 15% | modified anionic pure acrylate copolymer emulsion, |
| | wetting agent, and |
| | aliphatic polyfunctional isocyanurate. |

Epotal 181 D from BASF AG may be used, for example, as the ethylene-containing copolymer and Vinnapas EP 16 from Wacker Chemie AG can be used as the copolymeric ethyl Vinnapas AF 75 comes into consideration, for example, for the acrylic resin copolymer and Vinnapas Z 50 may be used, for example, as the polyvinyl acetate polymer.

The aliphatic polyester urethane acrylate serves as an adhesion promoter on the film surface and improves film properties such as elasticity and water resistance. The substance 2-(((butylamino)carbonyl)oxy)ethylester has, inter alia, the effect of making it possible to emulsify the aliphatic polyester urethane acrylate and fix ink pigments in the film.

A suitable modified anionic pure acrylate copolymer emulsion can be obtained from Zeneca Resins under the trade name NeoCryl.

An aqueous solution of a fully or partially saponified polyvinyl alcohol or a commercially available standard product is preferably used as the wetting agent.

Figure 4:
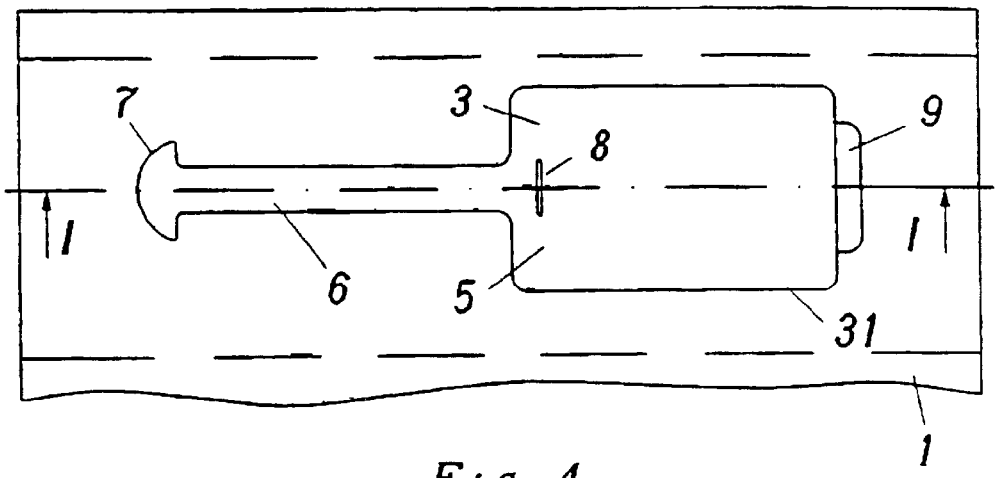
FIG. 4 shows in plan view a form according to the invention with integrated tag.
Figure 5:
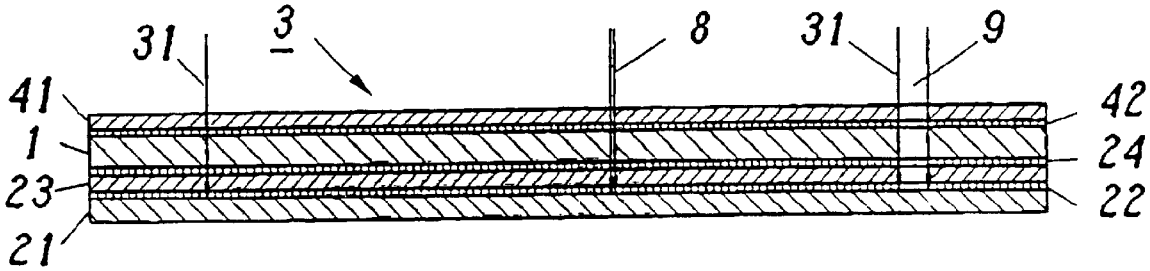
FIG. 5 shows the same form in section (section I—I)

In FIG. 4, a form sheet, which may have a customary letter format for example, is again denoted by 1. However, only the upper part of it is represented. A substrate material glued to the back of the form sheet and a covering material glued to its front are indicated by the interrupted lines. In the form, a punched product 3 in the form of a tag is punched out by a punching (punched line 31 running all the way around without intermittent material). The punched product or tag 3 has a label part 5 and a loop part 6. The label part 5 is advantageously arranged on the form sheet 1 in the customary address area, so that, when an address is printed on, the tag is written on in the same operation. The loop part 6 is provided at its free end with a widening 7, which is intended to be inserted into an insert slot 8 in the label part 5 and hook in it. A further punching clearance is denoted by 9 alongside the right-hand edge of the label part 5 of the tag 3. The punched product has already been detached here, however, so that the edge mentioned is exposed and can be easily picked up with a finger or a fingernail. The punching clearance 9 consequently forms a kind of removal aid. The multilayer construction of the form from FIG. 4 can be seen along the sectional line I—I in FIG. 5. From top to bottom, the following layers are present: an outer layer comprising film 41, a permanent pressure-sensitive adhesive layer 42, the actual form material 1, a further permanent pressure-sensitive adhesive layer 24, a further outer layer comprising film 23, a peeling adhesive layer 22 which can be written on, of the type previously described, and finally a substrate layer 21. For the purpose of being able to be written or printed on, the film 41 may be specially coated. An additional release layer on the back of the substrate layer has been dispensed with here.

As represented by the correspondingly denoted arrows, the punching 31 for producing the tag 3 in the form sheet 1 is made from the front of the form as far as the substrate layer 22, which itself is unharmed, i.e. is not punched through in the same operation. The tag 3 is held in the form sheet 1 by means of the continuous substrate layer 21.

The punching clearance 9 for producing a removal aid is likewise made as far as the depth of the substrate layer 21, but a gripping-through hole, through which it is possible for a finger to grip behind the edge of the tag 3, could be punched out equally well. Incisions or perforation lines which allow or facilitate exposure of a tag edge or a gripping zone by the user only directly before removal of the tag could also be provided on their own or in addition.

Figure 6:
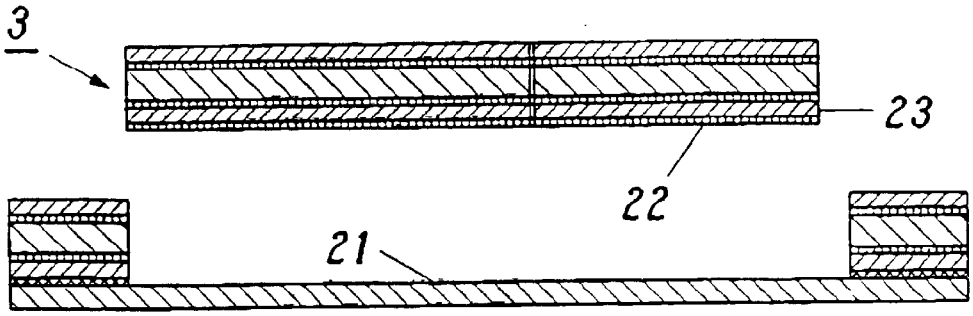
FIG. 6 shows a representation corresponding to FIG. 5, but with detached tag.

FIG. 6 shows the form 1 with detached tag 3. The separation in the multilayer material has taken place between the peeling adhesive layer 15 and the substrate layer 21 and the peeling adhesive has stayed with the tag 3. The peeling-adhesive layer 15 consequently again has its typical properties (non-permanent adhesive effect) with respect to the substrate layer 21. The rear side of the detached tag 3 can be written on through the peeling adhesive layer.

Figure 7:
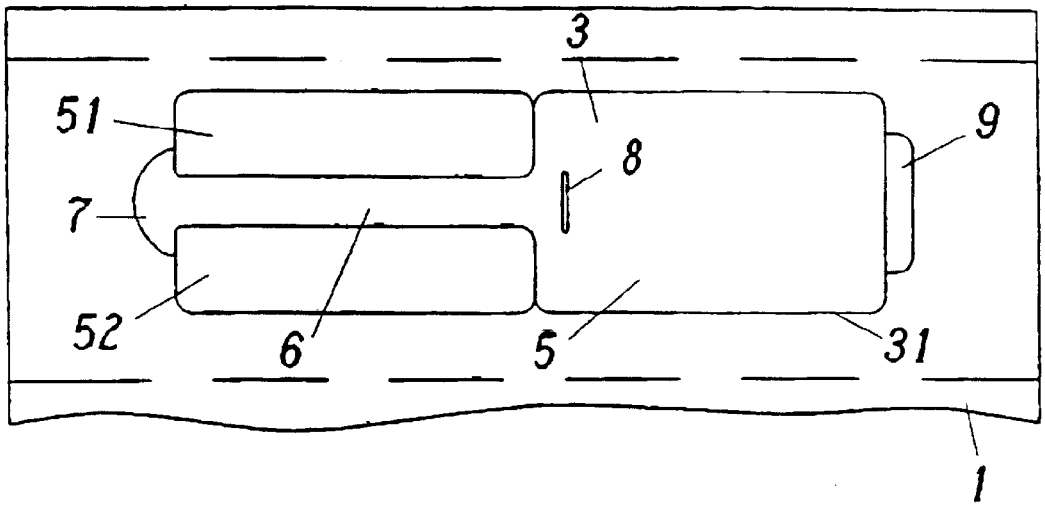
FIG. 7 shows in plan view a form according to the invention with integrated tag according to FIG. 4 as well as additional control cards.
Figure 8:
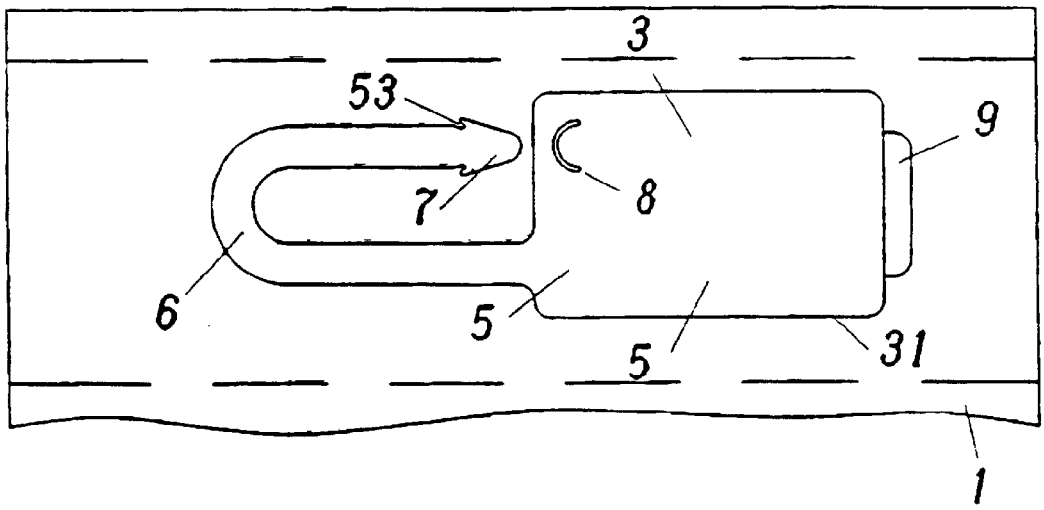
FIG. 8 shows in plan view a form according to the invention with integrated tag of a different shape.

In the example of FIG. 7, cards 51 and 52, which like the tag 3 can be detached from the form and can be advantageously used for further purposes, for example as control or identity cards, have been additionally punched out respectively on both sides of the loop part 6 in the case of a tag 3 according to FIG. 4.

FIG. 7 [sic] also shows a tag 3 in which the loop part 6 is bent back toward the label part 5. Notches 53 are provided behind the widening 7 at the free end of the loop part 4. The insert slot 8 in the label part 5 is of an arcuate design. This design allows the widened end 7 of the loop part 4 to be easily inserted into the insert slot 6 and it is then hooked particularly effectively in [lacuna].

In all the figures, which show sectional illustrations of forms according to the invention, the thicknesses of the layers are not represented to scale but greatly exaggerated for the purpose of better clarity.

In cases in which it is desired that the card (or a tag) can be printed on as long as it is still integrated in the form, this can be made possible on a partial surface area of the card by punching out a hole in the substrate layer 21.

What is claimed is:

1. Form (1) with a detachable card (3), a substrate material (2) being glued to the back of the form, which substrate material at least partly covers the area of the card (3) and comprises both a substrate layer (21) and a peeling adhesive layer (22) which loses its stickiness upon being detached, and the card (3) being a punched product which is held in the form (1) by the substrate layer (21) and is produced by a punching carried out from the front of the form as far as the substrate layer (21), characterized in that the peeling adhesive layer (22) develops a permanent adhesive effect with respect to the card (3) but a non-permanent adhesive effect with respect to the substrate layer (21) and can be directly written or printed on as a surface layer of the detached card (3).

2. Form according to claim 1, characterized in that the substrate material (2) additionally has before the peeling adhesive layer (22) and the substrate layer (21), as seen in the punching direction, a first permanent pressure-sensitive adhesive layer (24) and a first outer layer (23).

3. Form according to claim 1 or 2, characterized in that the substrate material (2) has as the last, outermost layer, as seen in the punching direction, a release layer (25).

4. Form according to one of claims 1 or 2, characterized in that a covering material (4), which covers the area of the card (3) and has a second outer layer (41) and a second permanent pressure-sensitive adhesive layer (42), is glued to the front of the form.

5. Form according to one of claims 1 or 2, characterized in that paper or film is used as the material for the form (1), the outer layer(s) (23, 41) and/or the substrate layer (21), to be precise paper is preferably used for the form and film is preferably used for the outer layer(s) and the substrate layer.

6. Form according to claim 2, characterized in that the material for the outer layer(s) (23, 41) and/or the substrate layer (21) is transparent.

7. Form according to one of claims 1, 2 or 6, characterized in that the punching (31) is carried out such that it runs all the way around without leaving intermediate material.

8. Form according to one of claims 1, 2 or 6, characterized in that the peeling adhesive of the peeling adhesive layer (21) has the following composition in % by weight:

70–90%, preferably 77%, of [sic] a mixture of an ethylene-containing copolymer, a copolymeric ethyl acetate dispersion, an acrylic resin copolymer and a polyvinyl acetate polymer;

3–5%, preferably 4%, aliphatic polyester urethane acrylate;

1.5–2.5%, preferably 2%, 2-acrylic acid, 2-(((butylamino) carbonyl)oxy)ethylester;

12–18%, preferably 15%, modified anionic pure acrylate copolymer emulsion;

0–1.5%, preferably 1%, wetting agent; and 0.5–1.5%, preferably 1%, aliphatic polyfunctional isocyanurate.

9. Form according to one of claims 1, 2, or 6, characterized in that the card (3) is designed as a tag for cases or the like.

10. Form according to claim 9, characterized in that the tag (3) has a label part (5) and a loop part (6), the loop part is provided at its free end with a widening (7) and an insert slot (8) for this end is provided in the label part.

11. Form according to claim 10, characterized in that the loop part (6) of the tag (3) is of a straight design.

12. Form according to claim 10, characterized in that the loop part (6) of the tag (3) is designed such that it is bent back toward the label part (5) of the latter.

13. Form according to of claim 10, characterized in that the insert slot (8) in the label part (5) of the tag (3) is bent and notches (53) are provided on both sides behind the widening (7) at the free end of the loop part (6) of the tag.

14. Form according to claim 9, characterized in that additional, integrated and detachable cards (51, 52) are punched out preferably alongside the tag (3).

15. Form according to claim 9, characterized in that, for the purpose of producing a removal aid (9), one edge of the tag is exposed, or can be exposed before detaching the latter, by at least one additional punching or least one additional incision.

16. Process for producing a form according to one of claims 1, 2 or 6, characterized in that the surfaces with which the peeling adhesive layer (22) in the substrate material (2) is in contact are subjected to different pretreatments by a plasma, corona or a flame treatment for achieving a differentiated adhesive effect.

17. Substrate material (2), formed according to one of claims 1, 2 or 6.

18. Multilayer material comprising all the layers of a form according to one of claims 1, 2 or 6, all the layers being of the same size.

* * * * *